US007239308B2

(12) United States Patent
Satoh et al.

(10) Patent No.: US 7,239,308 B2
(45) Date of Patent: Jul. 3, 2007

(54) IMAGE DISPLAY APPARATUS

(75) Inventors: Junichi Satoh, Yokohama (JP); Fumio Haruna, Yokohama (JP); Toshimitsu Watanabe, Yokohama (JP); Yoshihisa Ooishi, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 483 days.

(21) Appl. No.: 10/928,352

(22) Filed: Aug. 30, 2004

(65) Prior Publication Data

US 2006/0007202 A1 Jan. 12, 2006

(30) Foreign Application Priority Data

Jun. 3, 2004 (JP) ..... 2004-165252

(51) Int. Cl.
*G09G 5/00* (2006.01)

(52) U.S. Cl. ..... 345/204; 345/210; 345/211; 345/212

(58) Field of Classification Search ..... 345/87–102, 345/204–215, 690
See application file for complete search history.

(56) References Cited

U.S. PATENT DOCUMENTS 5,825,670 A * 10/1998 Chernoff et al. ..... 702/85
6,091,381 A 7/2000 Uenuma ..... 345/74
6,137,458 A 10/2000 Uenuma ..... 345/74
2003/0006947 A1 1/2003 Mooon
2003/0030654 A1 2/2003 Sagano et al.
2003/0107542 A1 6/2003 Abe et al.
2003/0210211 A1 11/2003 Moon
2004/0001039 A1 1/2004 Shino et al.
2006/0050065 A1* 3/2006 Maki ..... 345/204
2006/0202933 A1* 9/2006 Pasch et al. ..... 345/94

FOREIGN PATENT DOCUMENTS

JP 07-325554 12/1995
JP 06-248921 9/1996

* cited by examiner

*Primary Examiner*—Vijay Shankar
(74) *Attorney, Agent, or Firm*—Antonelli, Terry, Stout & Kraus, LLP.

(57) ABSTRACT

An image display apparatus includes scanning line control circuits for supplying a scanning voltage $V_{scan}$ for selecting a plurality of electron sources in a unit of line to scan them in the vertical direction to the selected electron sources, a signal line control circuit for supplying a drive voltage $V_{data}$ based on an image signal to the electron sources of one line, and a signal processing circuit having a correction circuit, and the correction circuit corrects the image signal to add to the drive voltage $V_{data}$ an offset for compensating a voltage drop caused by an internal resistance R of a switch circuit in the scanning line control circuit, so that the voltage drop caused by the internal resistance of the switch circuit is compensated to lower or suppress reduction of brightness.

18 Claims, 4 Drawing Sheets

IMAGE DISPLAY APPARATUS

BACKGROUND OF THE INVENTION

The present invention relates to technique for correcting the image quality of an image display apparatus such as a field emission display (hereinafter abbreviated to FED).

An FED includes electron sources which are disposed at intersections of a plurality of scanning lines extending in the horizontal direction and a plurality of signal lines extending in the vertical direction and each of which is driven by a scanning voltage applied through the scanning line and a drive voltage applied through the signal line (in accordance with an image signal).

In such an FED, a voltage drop is produced by a wiring resistance of the scanning line, so that deterioration in the image quality such as nonuniformity of brightness is produced. As conventional techniques for correcting the deterioration in the image quality, techniques described in, for example, JP-A-7-325554 and JP-A-8-248921 are known. JP-A-325554 discloses a scanning line control circuit for applying a scanning voltage and connected to both of right and left ends of the scanning lines to be operated alternately for each scanning line or each frame, so that apparent nonuniformity of brightness is reduced. JP-A-8-248921 discloses that a correction signal having a level conformable to a wiring resistance in each electron source is added to a brightness signal to correct nonuniformity of brightness.

The scanning line control circuit applies the scanning voltage to each scanning line successively so as to select the plurality of scanning lines arranged in the vertical direction successively one by one (occasionally two by two). The scanning voltage is produced by switching a non-selection potential (0 V, for example) and a selection potential (−5 or 5 V, for example) by a switch circuit disposed in the scanning line control circuit. In other words, the switch circuit makes the switching operation so that the non-selection potential (0 V) is applied to the non-selected scanning line and the selection potential (−5 or 5 V) is applied to the selected scanning line.

The switch circuit has as relatively large an internal resistance as about 10 to 20 Ω when it is composed of, for example, an analog circuit and the internal resistance occupies a large percentage in the internal resistance of the scanning line control circuit. Since the internal resistance of the switch circuit is a resistance to a current flowing through all electron sources of one line, uniform voltage drops are produced in the respective electron sources of the selected line (when levels of the image signals for the selected line are equal in each horizontal position). In other words, the internal resistance of the switch circuit is a factor causing reduction of the brightness which is one of deterioration in the image quality and it is difficult to reproduce the brightness expressed by an original image signal sufficiently. For example, even when an image signal having the brightness of 100% is to be displayed, the image signal having the brightness of, for example, only 95% can be displayed due to the voltage drop produced by the internal resistance.

Accordingly, in order to attain the higher image quality in the FED, it is important to compensate the voltage drops produced by not only the wiring resistance of the scanning line but also the internal resistance of the switch circuit so that the reduction of brightness is lowered or suppressed. However, both of JP-A-7-325554 and JP-A-8-248921 take account of only the voltage drop produced by the wiring resistance of the scanning line but do not take account of the voltage drop produced by the internal resistance of the switch circuit, so that the reduced brightness cannot be compensated suitably.

SUMMARY OF THE INVENTION

It is an object of the present invention to provide technique suitable for improving the image quality in the field emission display (FED).

In order to achieve the above object, the image display apparatus according to the present invention comprises a correction circuit for correcting a potential difference in a head electron source, disposed nearest to a scanning voltage supply circuit as a minimum, of electron sources of one selected line on the basis of a level of the image signal. The correction of the potential difference by the correction circuit is made by giving to at least one of the scanning voltage and the drive voltage supplied to the head electron source an offset conformable to the level of the image signal for the electron sources of the one selected line. The offset has a level for compensating voltage drop caused by an internal resistance of the scanning voltage supply circuit constituting a scanning line control circuit, particularly an internal resistance of a switch circuit included in the scanning voltage supply circuit.

According to the above configuration, since the drive voltage or scanning voltage which is previously given the offset is supplied to electron sources of the selected line containing the head electron source, a potential difference increased by the offset is supplied to electron sources when the electron sources are driven. The offset cancels out the voltage drop caused by the internal resistance of the switch circuit at the electron sources of the selected line. Therefore, according to the present invention, reduction of the brightness due to the voltage drop can be lowered or suppressed to improve the image quality.

Further, the correction circuit according to the present invention may produce a first correction signal for giving a fixed offset to the drive voltage supplied to each of the electron sources of the one selected line or the scanning voltage when image signals for the electron sources of the one selected line are equal to each other and a second correction signal for increasing the potential difference at each of the electron sources of the one selected line in accordance with a distance between each electron source and the scanning line control circuit. The first correction signal is to compensate the voltage drop caused by the internal resistance of the switch circuit and the second correction signal is to compensate the voltage drop caused by the wiring resistance of the scanning line.

Such a correction circuit can be used to compensate both of the voltage drop caused by the internal resistance of the switch circuit and the voltage drop caused by the wiring resistance of the scanning line. Therefore, according to the present invention, deterioration in the image quality can be reduced and the image quality of a displayed image can be improved highly.

Other objects, features and advantages of the invention will become apparent from the following description of the embodiments of the invention taken in conjunction with the accompanying drawings.

DETAILED DESCRIPTION OF THE EMBODIMENTS

Embodiments of the present invention are now described with reference to the accompanying drawings.

Embodiment 1

Figure 1:
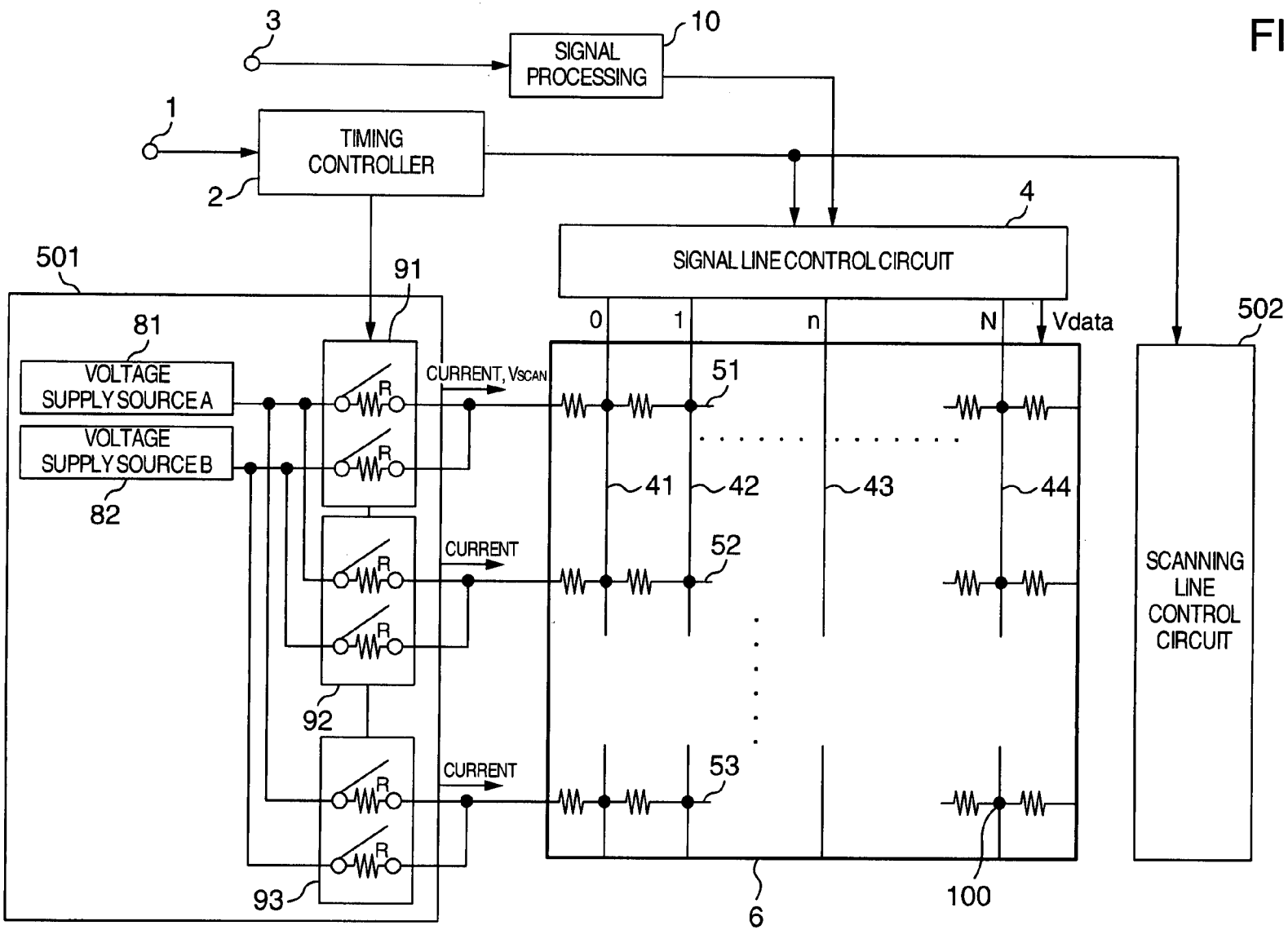
FIG. 1 is a block diagram schematically illustrating a first embodiment of an image display apparatus according to the present invention.

FIG. 1 schematically illustrates an embodiment of an image display apparatus provided with a field emission display (FED), according to the present invention. In the embodiment, an FED of the passive-matrix driving system having electron sources of MIM (Metal-Insulator-Metal) type is described by way of example. However, the present invention can be applied to even electron sources such as, for example, SCE type and carbon nano-tube type other than the MIM type similarly. Further, the following description is made to the image display apparatus including two scanning line control circuits 501 and 502 connected to both ends of the scanning lines by way of example. However, it is needless to say that the present invention can be applied to even the image display apparatus including only one of the scanning line control circuits.

An image signal is inputted through an image signal input terminal 3 to a signal processing circuit 10. The signal processing circuit 10 subjects the image signal to a variety of predetermined signal processing such as γ correction, color correction, contrast correction and the like. Further, the signal processing circuit 10 includes a correction circuit described in detail with reference to FIG. 2. The correction circuit acts to compensate voltage drops produced by internal resistances of switch circuits 91 to 93 included in the scanning line control circuits 501 and 502 constituting a scanning voltage supply circuit and voltage drops produced by wiring resistances of scanning lines 51 to 53. The detailed operation thereof will be described later.

A horizontal synchronization signal corresponding to the input image signal is inputted through a horizontal synchronization signal input terminal 1 to a timing controller 2. The timing controller 2 produces a timing pulse synchronized with the horizontal synchronization signal to supply it to the scanning line control circuits 501 and 502.

On the other hand, a display panel 6 includes a plurality of scanning lines 51 to 53 extending in the horizontal direction of a screen (in the right and left directions of the paper) and juxtaposed in the vertical direction of the screen (in the up-and-down direction of the paper). Further, a plurality of signal lines 41 to 44 extending in the vertical direction of the screen (in the up-and-down direction of the paper) are juxtaposed in the horizontal direction of the screen (in the right and left directions of the paper). The scanning lines 51 to 53 and the signal lines 41 to 44 orthogonally cross each other and electron sources 100 (electron emission elements) connected to the scanning lines and the signal lines are disposed at intersections of the scanning lines and the signal lines. The plurality of electron sources 100 are arranged into a matrix.

The scanning line control circuits 501 and 502 are connected to both of right and left ends of the scanning lines 51 to 53, respectively. The scanning line control circuits 501 and 502 supply to the scanning lines 51 to 53 a scanning voltage (which may be hereinafter abbreviated to $V_{scan}$) for selecting one or two scanning lines 51 to 53 in synchronism with the timing pulse from the timing controller 2. That is, the scanning line control circuits 501 and 502 apply the scanning voltage for horizontal synchronization to the scanning lines 51 to 53 successively to thereby select the electron sources of one or two scanning lines in order from above at the horizontal period so that the vertical scanning is made.

The scanning line control circuits 501 and 502 each include a voltage supply source A 81 for supplying the selection potential (e.g. 5 or −5 V), a voltage supply source B 82 for supplying the non-selection potential (e.g. 0 V), and switch circuits 91 to 93. The switch circuits 91 to 93 are connected to the scanning lines 51 to 53, respectively, and have internal resistances R. The switch circuits 91 to 93 make switching in response to the timing pulse from the timing controller 2 so that the selection potential from the voltage supply source A 81 is supplied to a relevant scanning line when the relevant scanning line is selected and the non-selection potential from the voltage supply source B 82 is supplied to the scanning lines when the scanning lines are not selected. That is, the scanning voltage $V_{scan}$ is formed by switching the selection potential and the non-selection potential by the switch circuits 91 to 93. In FIG. 1, for the sake of simplification of description, only the internal configuration of the scanning line control circuit 501 is shown, although the scanning line control circuit 502 is also provided with the same configuration. Further, the scanning line control circuits 501 and 502 may be switched alternately for each scanning line or each frame to be driven or operated. Further, when a single scanning line is selected, both the scanning line control circuits 501 and 502 may be driven simultaneously to apply the scanning voltage to the single scanning line simultaneously. Moreover, as described above, the present invention can be applied to even the configuration in which only one of the scanning line control circuits 501 and 502 is used.

A signal line control circuit 4 constituting a drive voltage supply circuit is connected to upper ends of the signal lines 41 to 44. The signal line control circuit produces a drive signal (which may be hereinafter abbreviated to $V_{data}$) for each signal line (electron source) on the basis of the image signal supplied from the signal processing circuit to supply it to each signal line. When the drive signal from the signal line control circuit 4 is applied to each electron source connected to the scanning line selected by the scanning voltage, a potential difference between the scanning voltage and the drive voltage is applied to each electron source. When the potential difference exceeds a predetermined threshold, the electron source emits electrons. An amount of electrons emitted from the electron source is substantially proportional to the potential difference when the potential difference is larger than or equal to the threshold. Further, when the drive voltage is positive, the scanning voltage is negative and when the drive voltage is negative, the scanning voltage is positive. A fluorescent substance or acceleration electrode not shown is disposed at a position opposite to each electron source. Space between the electron sources and the fluorescent substances is vacuum. Electrons emitted from the electron source is accelerated by a high voltage applied to the acceleration electrode and progress in the vacuum, so that the electrons collide with the fluorescent substance. Consequently, the fluorescent substance emits light and the light is discharged outside through transparent glass substrate not shown. Thus, an image is displayed on a display screen of the FED.

Figure 6:
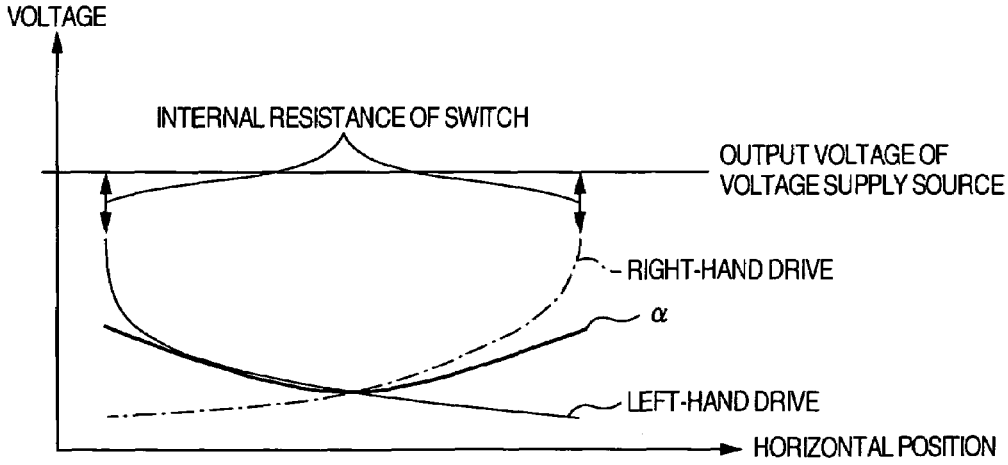
FIG. 6 is a diagram explaining voltage drops produced by a wiring resistance of a switch circuit and a wiring resistance of a scanning line.

FIG. 6 shows a change characteristic of the drive voltage versus the horizontal position of electron sources in the FED of the above configuration. Solid line of FIG. 6 represents a drive voltage versus horizontal position characteristic of electron sources upon being driven by the scanning line control circuit 501 (left-hand drive) and one-dot chain line represents a drive voltage versus horizontal position characteristic of electron sources upon being driven by the scanning line control circuit 502 (right-hand drive). As shown in FIG. 6, the voltage drop is largest and the drive voltage is smallest at the right end of the scanning line in the left-hand drive and at the left end of the scanning line in the right-hand drive. However, when the drive voltages are averaged for a longer time as compared with the scanning period, the averaged drive voltage becomes a value of a indicated by thick line of FIG. 6 and the uneven distribution of the drive voltage in the horizontal direction is alleviated. The reason why the drive voltage is made small as the right end of the scanning line is approached in the left-hand drive and the drive voltage is made small as the left end of the scanning line is approached in the right-hand drive is the voltage drops caused by the wiring resistances of the scanning line. That is, the wiring resistance is larger as the distance from the scanning line control circuit 501 or 502 is longer and is largest at the position of the electron source which is farthest from the scanning line control circuit 501 or 502.

Further, a relatively large voltage drop is produced even at the electron source (which may be hereinafter referred to as a head electron source disposed nearest to the scanning line control circuit 501 or 502. This is caused by the internal resistance R of the switch circuits 91 to 93 in the scanning line control circuit 501 or 502 described above.

Since the wiring distance between the head electron source and the scanning line control circuit 501 or 502 is short, the wiring resistance at the head electron source is small and the voltage drop produced thereacross is also small. However, since the internal resistance of the switch circuits 91 to 93 is as relatively large as 10 to 20 Ω, a relatively large voltage drop (about 0.6 V when white is displayed on the entire display screen) is produced even at the head electron source. The voltage drop by the internal resistance of the switch circuit influences all of the electron sources of the selected scanning line containing the head electron source. Accordingly, even when the image signal having the brightness of, for example, 100% is to be displayed, the image having the brightness of only 95% can be displayed. In other words, the internal resistance of the switch circuit reduces the brightness and deteriorates the reproducibility of the image signal. The inventors discover that the brightness is reduced by the internal resistance of the switch circuit and have made the present invention in order to lower or suppress the reduction of the brightness.

Figure 2:
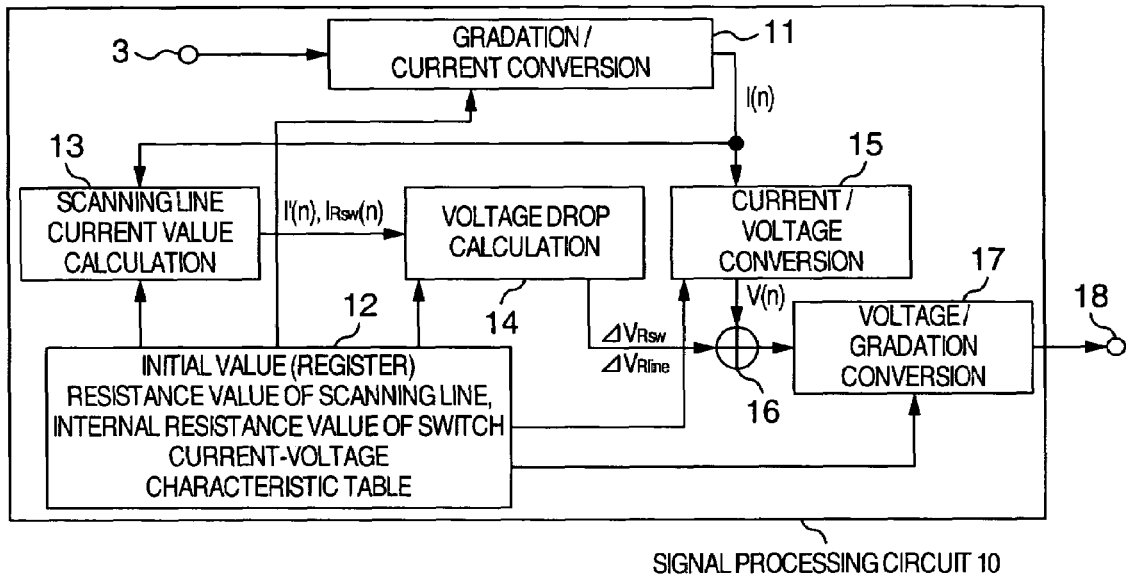
FIG. 2 is a block diagram schematically illustrating a concrete example of a signal processing circuit 10 shown in FIG. 1.

Referring now to FIG. 2, a correction circuit according to the present invention for compensating such a voltage drop is described in detail. FIG. 2 is a block diagram illustrating a concrete example of the signal processing circuit containing the correction circuit. The correction circuit shown in FIG. 2 is to correct both of the wiring resistance of the scanning line and the internal resistance of the switch circuit. In FIG. 2, a gradation/current conversion block 11 converts a gradation signal of the image signal inputted from the image signal input terminal 3 into a current. A register 12 previously stores parameters concerning wiring resistance values of scanning lines, internal resistance values of switch circuits, a current-voltage characteristic table, a voltage-gradation characteristic table, a gradation-voltage characteristic table and the like. The register 12 supplies various parameters stored therein to the gradation/current conversion block 11, a scanning line current value calculation block 13, a voltage drop calculation block 14, a current/voltage conversion block 15 and a voltage/gradation conversion block 17. The blocks 11, 13, 14, 15 and 17 receive the parameters given from the register 12 as initial values to make various calculation of current values of scanning lines, voltage drops, voltage values, gradations and the like. An adder block 16 adds an output from the voltage drop calculation block 14 and an output from the current/voltage conversion block and supplies its addition result to the voltage/gradation conversion block 17. An output from the voltage/gradation conversion block 17 is supplied through an output terminal 18 to the signal line control circuit 4. The blocks 12 to 16 of the signal processing circuit 10 constitutes the correction circuit.

An example of the concrete signal processing algorithm performed by the blocks shown in FIG. 2 is now described. The image signal is inputted through the image signal input terminal 3 of FIG. 1 to the signal processing circuit 10. In the signal processing circuit 10, the image signal is inputted to the gradation/current conversion block 11 of FIG. 2 and converted into a current value corresponding to gradation of each pixel. When the starting point of an image in the horizontal direction is defined to be the 0-th, a current value I(n) of a n-th pixel is calculated, for example, by the equation (1), where D represents gradation of the inputted image signal, $D_{max}$ a maximum value of the inputted gradation, $I_0$ a current value of one pixel when the inputted gradation is 0, $I_{max}$ a current value of one pixel when the inputted gradation is maximum, γ a gradation characteristic constant, and n a position of a pixel when the starting point of an image at any scanning line is defined to be the 0-th. An output I(n) of the gradation/current conversion block 11 is inputted to the scanning line current value calculation block 13 and the current/voltage conversion block 15. The scanning line current value calculation block 13 calculates a current component $I_{Rsw}$ contributed by the internal resistance $R_{sw}$ of the switch circuit, of the current flowing through the n-th pixel and the current I' (n) flowing through the n-th pixel with reference to the values stored in the register 12. The current component $I_{Rsw}$ is calculated by, for example, the equation (2), where κ is a coefficient having the internal resistance $R_{sw}$ of the switch circuit as a parameter, and the current I'(n) is calculated by, for example, the equation (3). The outputs $I_{Rsw}$ (n) and I'(n) of the scanning line current value calculation block 13 are supplied to the voltage drop calculation block 14. The voltage drop calculation block 14 calculates a voltage drop $\Delta V_{Rsw}$ by $R_{sw}$ and a voltage drop $\Delta V_{Rline}(n)$ per pixel by $R_{line}$ with reference to the values stored in the register 12. The voltage drops $\Delta V_{Rsw}$ and $\Delta V_{Rline}(n)$ are calculated by, for example, the equations (4) and (5), respectively. In the above equations, i and j are an integer and $R_{sw}$ is the internal resistance value of the change-over switch.

$$I(n)=I_0+(I_{max}-I_0)\times(D/D_{max})^{\gamma} \quad (1)$$

where

D: gradation of inputted image signal, $D_{max}$: maximum value of inputted gradation, $I_0$: current value of one pixel when inputted gradation is 0, $I_{max}$: current value of one pixel when inputted gradation is maximum, γ: gradation characteristic constant, n: pixel position when starting point of image at any scanning line is 0-th, and I(n): current flowing through n-th pixel.

$$I_{Rsw}(n)=\kappa\times I(n) \tag{2}$$

where $I_{Rsw}(n)$: current contributed by internal resistance of change-over switch of scanning line control circuit, of current flowing through n-th pixel, κ: coefficient having internal resistance of change-over switch of scanning line control circuit as parameter, and other variables are the same as those defined in equation (1).

$$I'(n) = I'(0) + n \times \sum^{all\ pixels\ of\ one\ line} I_{Rsw}(n) + \sum_{i=1}^{n}\sum_{j=1}^{i} I(n) \tag{3}$$

where

I'(n): current flowing through n-th pixel when internal resistance of change-over switch of scanning line control circuit and wiring resistance of scanning line are considered, I and j: integer, and other variables are the same as those defined in equations (1) and (2).

$$\Delta V_{Rsw}=I'(0)\times R_{sw} \tag{4}$$

where $\Delta V_{Rsw}$: voltage drop by internal resistance of change-over switch of scanning line control circuit, $R_{sw}$: internal resistance value of change-over switch of scanning line control circuit, and other variables are the same as those defined in equations (1), (2) and (3).

$$\Delta V_{Rline}(n)=(I'(n)-I'(n-1))\times R_{line} \tag{5}$$

where $\Delta V_{Rline}(n)$: voltage drop by wiring resistance of scanning line at n-th pixel, $R_{line}$: resistance value per pixel of scanning line, and other variables are the same as those defined in equations (1), (2), (3) and (4).

The outputs $\Delta V_{Rsw}$ and $\Delta V_{Rline}(n)$ of the voltage drop calculation block 14 and the output V(n) of the current/voltage conversion block 15 are supplied to the adder block 16 and a voltage corrected by the voltage drop, that is, $\Delta V_{Rsw}+\Delta V_{Rline}(n)+V(n)$ is supplied to the voltage/gradation conversion block 17. The voltage V(n) is calculated in the current/voltage conversion block 15 by, for example, the equation (6), where λ and σ are coefficients.

$$V(n) = \frac{I'(n)}{2}\times\lambda \sum^{number\ of\ all\ pixels} R_{line}\times\log\left(\frac{I'(n)}{\sigma}+1\right) \tag{6}$$

The voltage/gradation conversion block 17 converts the calculated voltage $\Delta V_{Rsw}+\Delta V_{Rline}(n)+V(n)$ into a corrected image signal. The corrected image signal is inputted to the signal line control circuit 4 of FIG. 1 and the signal line control circuit 4 converts the image signal corrected by the voltage drop into a voltage $V_{data}$. The signal line control circuit supplies the voltage $V_{data}$ to the signal lines 41 to 45 in accordance with control of the timing controller 2.

Figure 3:
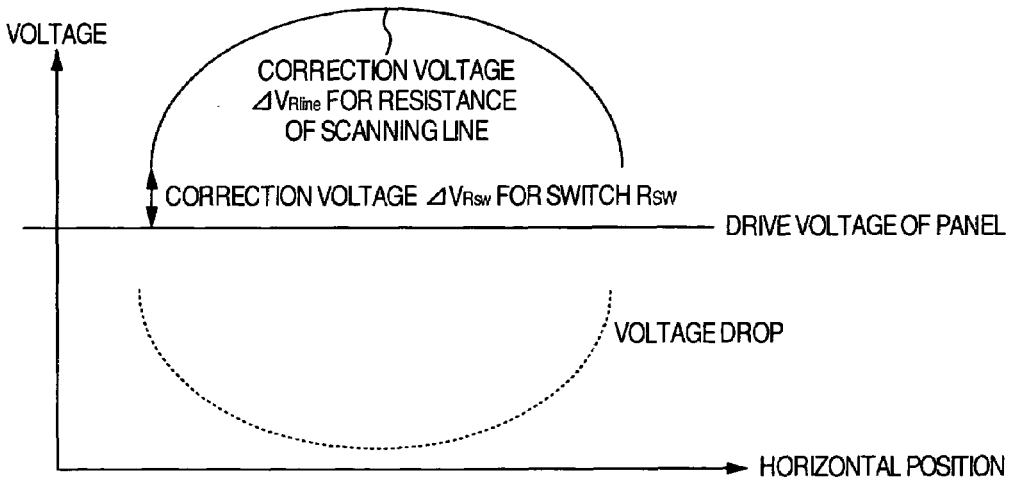
FIG. 3 is a diagram explaining correction of a drive voltage according to the present invention.

FIG. 3 shows an example of a correction voltage $\Delta V_{Rsw}+\Delta V_{Rline}(n)$ at the time that uniform image signal is inputted in the horizontal direction of the scanning lines 51 to 54 shown in FIG. 1. In FIG. 3, the abscissa axis represents the horizontal position of the display panel 6 and the ordinate axis represents a voltage. FIG. 3 shows the characteristic obtained when the scanning line control circuits 501 and 502 are operated simultaneously. As shown in FIG. 3, image processing is made so that the voltage $V_{data}$ for correcting the total voltage drop $\Delta V_{Rsw}+\Delta V_{Rline}(n)$ containing the internal resistance $R_{sw}$ of the switch is applied to the signal lines 41 to 45, so that reduction of the brightness at the position far from the power supply source is suppressed. Further, when the scanning line voltage $V_{scan}$ is applied from both of the right and left ends, the correction voltage is made small as compared with the case where the scanning line voltage $V_{scan}$ is applied from one end and accordingly the dynamic range of the inputted image signal can be increased.

As shown in FIG. 3, the correction circuit according to the embodiment adds an offset corresponding to the correction voltage $\Delta V_{Rsw}$ of the voltage drop produced by the internal resistance $R_{sw}$ of the switch circuit to the drive voltage $V_{data}$ of the selected line. The offset is changed due to the level of the image signal, while when the levels of the image signals for the selected line are identical in each horizontal position, the offset of each drive voltage supplied to each electron source of the selected line is identical.

Further, the correction circuit according to the embodiment also adds a correction voltage $\Delta V_{Rline}$ for compensating the voltage drop by the wiring resistance $R_{line}$ of the scanning line to the drive voltage $V_{data}$ of the selected line in addition to the offset. The correction voltage $\Delta V_{Rline}$ is different from the offset and when the levels of the image signals for the selected line are identical in each horizontal position, the level is changed in accordance with the distance of the electron source from the scanning line control circuit 501 or 502. In other words, the correction voltage $\Delta V_{Rline}$ is set to be increased as the distance is lengthened. In the example shown in FIG. 3, the level is largest at the middle position in the horizontal direction. When the scanning line control circuit is provided at only one of right and left ends, for example, only the left end, the correction voltage $\Delta V_{Rline}$ has a largest level at the right end of the scanning line.

As described above, in the embodiment, the correction circuit shown in FIG. 2 produces (1) a first correction signal (corresponding to the offset or correction voltage $\Delta V_{Rsw}$) for compensating the voltage drop caused by the internal resistance $R_{sw}$ of the switch circuit and (2) a second correction signal (corresponding to the correction voltage $\Delta V_{Rline}$) for compensating the voltage drop caused by the wiring resistance $R_{line}$ of the scanning line. These correction signals are used to correct the image signal, so that the drive voltage applied to the electron source can be corrected. Consequently, both of the voltage drops caused by the internal resistance $R_{sw}$ and the voltage drop caused by the wiring resistance $R_{line}$ can be compensated, so that not only reduction of the brightness but also nonuniformity of the brightness can be lowered.

Embodiment 2

Figure 4:
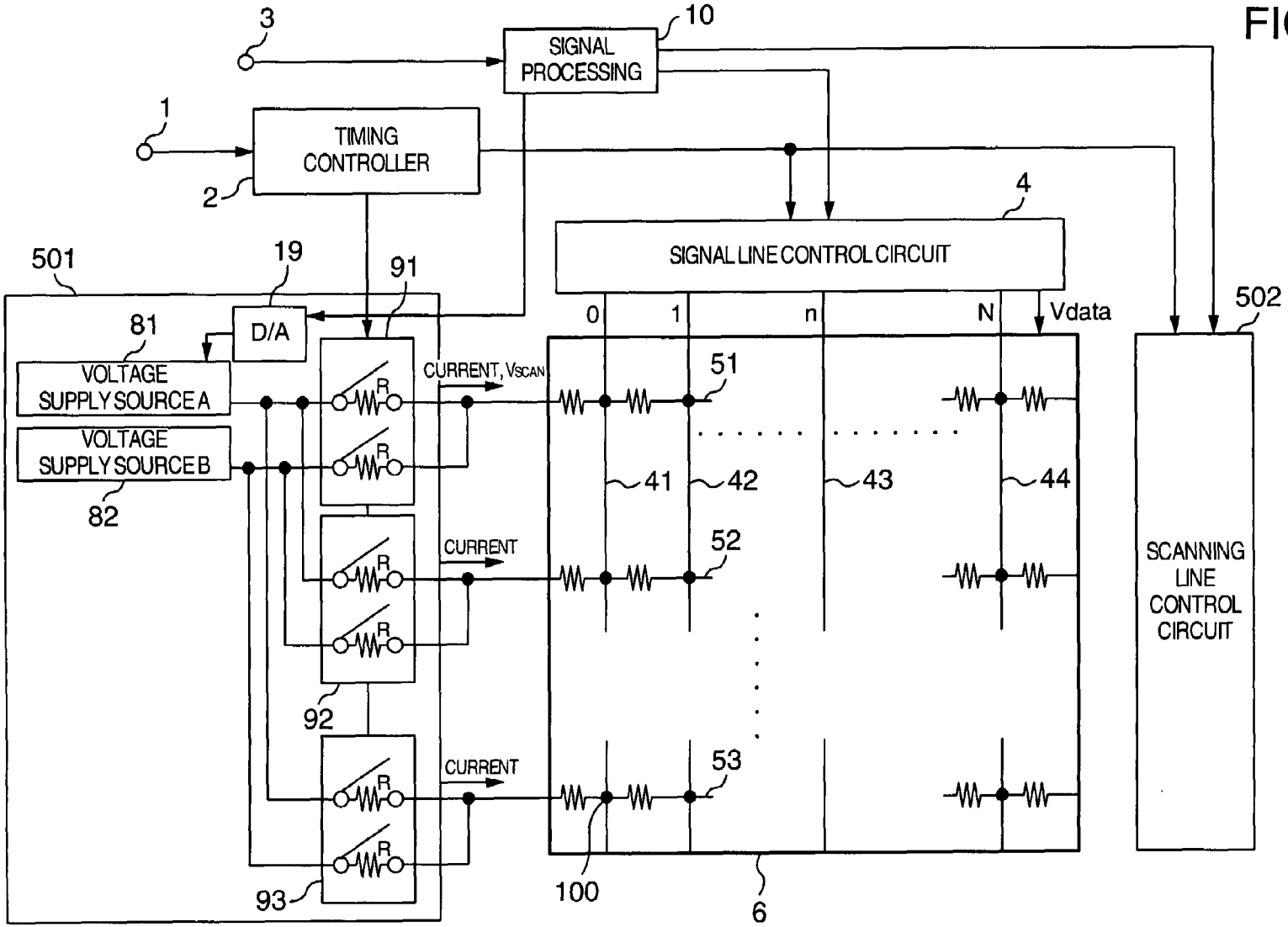
FIG. 4 is a block diagram schematically illustrating a second embodiment of an image display apparatus according to the present invention.

The second embodiment of the image display apparatus according to the present invention is now described. FIG. 4 is a block diagram illustrating the second embodiment of the present invention. In FIG. 4, like reference numerals to those shown in FIG. 1 designate like elements having the same function. The second embodiment is different from the first embodiment shown in FIG. 1 in that a D/A converter 19 is added to the scanning line control circuits 501 and 502 and the D/A converter 19 is supplied with a signal corresponding to the correction voltage $\Delta V_{Rsw}$ from the signal processing circuit 10. In the embodiment, the D/A converter 19 is provided in the scanning line control circuits 501 and 502, although it may be provided outside of the scanning line control circuits 501 and 502.

Figure 5:
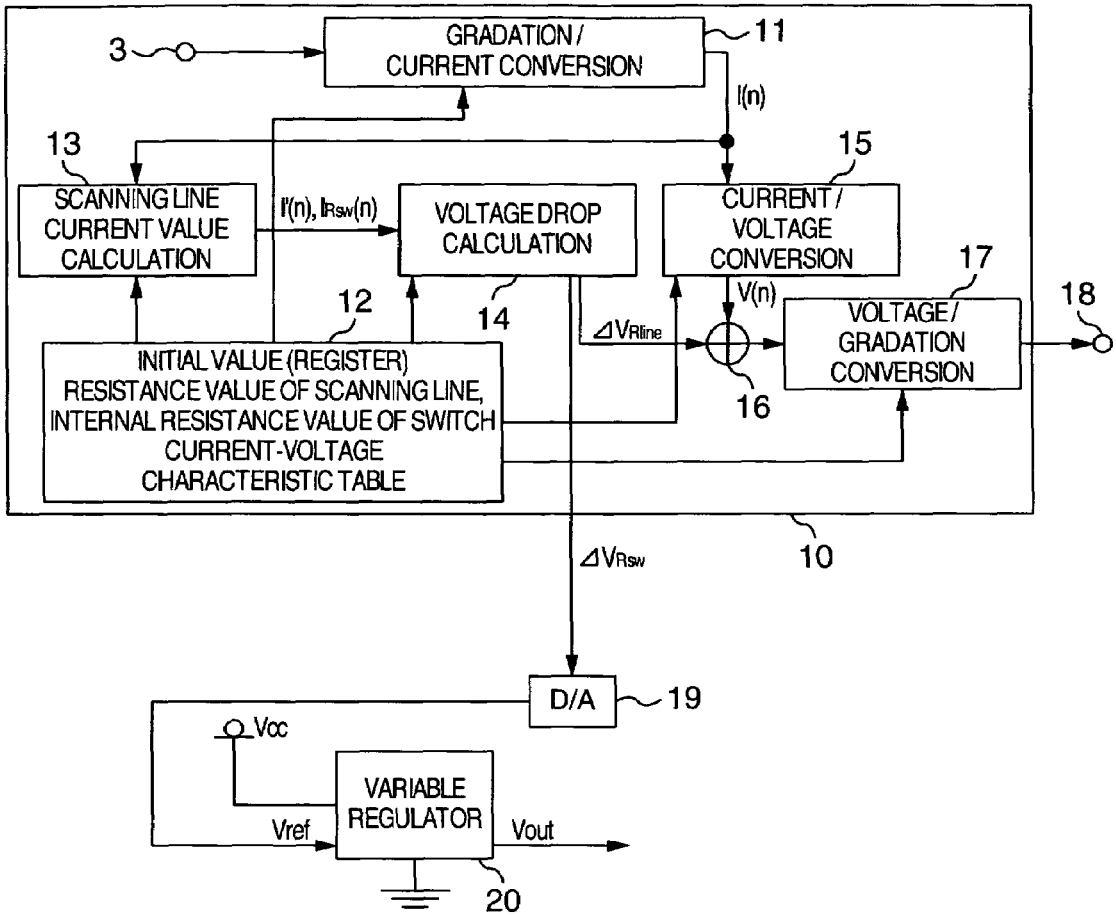
FIG. 5 is a block diagram schematically illustrating a concrete example of a signal processing circuit 10 shown in FIG. 4.

Operation of the second embodiment is now described with reference to FIG. 5. FIG. 5 is a block diagram illustrating a concrete example of the signal processing circuit 10 according to the second embodiment of the present invention. In FIG. 5, like reference numerals to those shown in FIG. 2 designate like elements having the same function. The embodiment of FIG. 5 is different from the embodiment of FIG. 2 in that the D/A converter 19 supplied with the correction voltage $\Delta V_{Rsw}$ from the voltage drop calculation block 14 and a variable regulator 20 having a reference voltage controlled by an output of the D/A converter 19 are provided. The variable regulator 20 has the same function as the voltage supply source 81 of FIG. 4. The image signal is inputted through the image signal input terminal 3 of FIG. 4 to the signal processing circuit 10. The image signal is subjected to the same processing as the first embodiment shown in FIG. 2 until it passes through the voltage drop calculation block 14 in the signal processing circuit 10. Among the outputs produced by the voltage drop calculation block 14, the correction voltage $\Delta V_{Rsw}$ for the voltage drop by the internal resistance $R_{sw}$ of the switch circuit is supplied to the D/A converter 19 and the voltage drop $\Delta V_{Rline}$ by the wiring resistance is supplied to the adder block 16. The correction voltage $\Delta V_{Rsw}$ inputted to the D/A converter 19 is converted into an analog voltage and used as the reference voltage of the variable regulator 20. The variable regulator 20 has the input/output characteristic that it outputs a scanning voltage proportional to the reference voltage. The variable regulator 20 uses the converted analog correction voltage $\Delta V_{Rsw}$ as the reference voltage to produce the selection potential having a value proportional to the reference voltage and outputs it as the scanning voltage $V_{out}$ to the scanning lines 51 to 53. Consequently, the correction voltage $\Delta V_{Rsw}$ conformable to the level of the image signal is added to the scanning voltage. Accordingly, the potential difference (between the drive voltage and the scanning voltage) in each electron source of the selected line can be enlarged by the correction voltage $\Delta V_{Rsw}$ to thereby compensate the voltage drop caused by the internal resistance $R_{sw}$ of the switch circuit.

On the other hand, the correction voltage $\Delta V_{Rline}$ inputted to the adder block 16 is added to the output V(n) produced by the current/voltage conversion block 15, so that the image signal compensated with regard to the voltage drop by the wiring resistance $R_{line}$ of the scanning line is produced. The output of the adder block 16 is converted into the gradation signal by the voltage/gradation conversion block 17 and outputted through the output terminal 18 to the signal line control circuit 4.

As described above, in the embodiment, the voltage drop by the wiring resistance $R_{line}$ of the scanning line is compensated on the side of the drive voltage (signal side) and the voltage drop by the internal resistance $R_{sw}$ of the switch circuit is compensated on the side of the scanning voltage (voltage supply source side). Accordingly, the correction voltage required in the image processing is only the voltage $\Delta V_{Rline}$, so that the dynamic range of the image signal can be increased as compared with the first embodiment. It is a matter of course that another voltage supply source may be used instead of the variable regulator so that correction for the switch circuit may be made by controlling the scanning voltage.

As described above, according to the present invention, the voltage drop of the drive voltage caused by the internal resistance of the switch circuit in the scanning line control circuit and the wiring resistance of the scanning line can be corrected, so that reduction of the brightness and deterioration in the image quality due to uneven distribution of the drive voltage can be suppressed. Further, the voltage drop caused by the internal resistance of the switch circuit is corrected by means of the scanning voltage and the voltage drop caused by the wiring resistance of the scanning line is corrected by means of the drive voltage, so that correction portion of the image signal can be reduced and the dynamic range can be increased.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An image display apparatus comprising:

a plurality of scanning lines extending in the horizontal direction and arranged in the vertical direction;

a scanning line control circuit connected to any one of right and left ends of said plurality of scanning lines and for applying a scanning voltage to said plurality of scanning lines successively in the vertical direction;

a plurality of signal lines extending in the vertical direction and arranged in the horizontal direction;

a signal line control circuit connected to said plurality of signal lines and for applying a drive voltage conformable to an inputted image signal to said plurality of signal lines;

electron sources each connected to each of intersections of said plurality of scanning lines and said plurality of signal lines and emitting electrons in accordance with a potential difference between said scanning voltage and said drive voltage; and a correction circuit wherein said correction circuit produces a first correction signal for giving an offset to said drive voltage supplied to each of said electron sources of one selected line or said scanning voltage and a second correction signal for increasing said potential difference at each of said electron sources of said one selected line in accordance with a distance between said electron sources and said scanning line control circuit when respective image signals for said electron sources of said one selected line are equal to each other.

2. An image display apparatus according to claim 1, wherein said correction circuit is included in a signal processing circuit which subjects predetermined signal processing to said image signal.

3. An image display apparatus according to claim 2, wherein said first correction signal corrects said image signal or said scanning voltage and said correction signal corrects said image signal.

4. An image display apparatus according to claim 1, wherein two scanning line control circuits are provided and when said scanning line control circuits are connected to both of right and left ends of said scanning line, respectively, the potential difference at said electron source positioned in the middle of said electron sources of said one selected line is made largest in accordance with said second correction signal.

5. An image display apparatus comprising:

a plurality of scanning lines extending in the horizontal direction and arranged in the vertical direction;

a scanning line control circuit connected to any one of right and left ends of said plurality of scanning lines and applying a scanning voltage to said plurality of scanning lines successively in the vertical direction;

a plurality of signal lines extending in the vertical direction and arranged in the horizontal direction;

a signal line control circuit connected to said plurality of signal lines and for applying a drive voltage conformable to an inputted image signal to said plurality of signal lines;

electron sources each connected to each of intersections of said plurality of scanning lines and said plurality of signal lines and emitting electrons in accordance with a potential difference between said scanning voltage and said drive voltage; and a correction circuit;

wherein said scanning line control circuit includes a switch circuit which switches a selection potential and a non-selection potential to form said scanning voltage; and said correction circuit produces a first correction signal for compensating a voltage drop produced by an internal resistance of said switch circuit and a second correction signal for compensating a voltage drop produced by a wiring resistance of said scanning line to correct said potential difference at said electron sources of said one selected line.

6. An image display apparatus according to claim 5, wherein said image signal or said scanning voltage is corrected by said first correction signal and said image signal is corrected by said second correction signal to thereby correct said potential difference.

7. An image display apparatus according to claim 5, wherein said correction circuit includes calculation means for calculating a voltage drop produced by an internal resistance (hereinafter abbreviated to $R_{sw}$) of said switch circuit and a voltage drop produced by a wiring resistance (hereinafter abbreviated to $R_{line}$) of said scanning line to produce said first and second correction signals.

8. An image display apparatus according to claim 7, wherein said calculation means calculates a current value I(n) flowing through said electron source on the basis of said drive voltage applied to said electron source and an emitted electron amount characteristic of said electron source by the following equation (1), calculates a contributed current $I_{Rsw}$ by $R_{sw}$ of the current flowing through said electron source by the following equation (2), calculates a current value I' (n) flowing through said electron source on the basis of said drive voltage lowered by $R_{sw}$ and $R_{line}$ by the following equation (3), calculates a voltage drop $\Delta V_{Rsw}$ caused by $R_{sw}$ by the following equation (4) and calculates a voltage $\Delta V_{Rline}$ lowered by $R_{line}$ at a position of said electron source by the following equation (5);

$$I(n)=I_0+(I_{max}-I_0)\times(D/D_{max})^{\gamma} \tag{1}$$

where

D: gradation of inputted image signal;

$D_{max}$: maximum value of input gradation;

$I_0$: current value for one pixel when input gradation is 0;

$I_{max}$: current value for one pixel when input gradation is maximum;

γ: gradation characteristic constant;

n: position of pixel when starting point of image is defined to be 0-th in any scanning line; and I(n): current flowing through n-th pixel;

$$I_{Rsw}(n)=\kappa\times I(n) \tag{2}$$

where $I_{Rsw}(n)$: current contributed by internal resistance of change-over switch of scanning line control circuit, of current flowing through n-th pixel;

κ: coefficient having internal resistance of change-over switch of scanning line control circuit as parameter; and other variables are the same as those defined in equation (1);

$$I'(n) = I'(0) + n \times \sum^{\text{all pixels of one line}} I_{Rsw}(n) + \sum_{i=1}^{n}\sum_{j=1}^{i} I(n) \tag{3}$$

where

I' (n): current flowing through n-th pixel when internal resistance of change-over switch of scanning line control circuit and wiring resistance of scanning line are considered;

i and j: integer; and other variables are the same as those defined in equations (1) and (2);

$$\Delta V_{Rsw}=I'(0)\times R_{sw} \tag{4}$$

where $\Delta V_{Rsw}$: voltage drop by internal resistance of change-over switch of scanning line control circuit;

$R_{sw}$: internal resistance of change-over switch of scanning line control circuit; and other variables are the same as those defined in equations (1), (2) and (3);

$$\Delta V_{Rline}(n)=(I'(n)-I'(n-1))\times R_{line} \tag{5}$$

where $\Delta V_{Rline}(n)$: voltage drop by wiring resistance of scanning line at n-th pixel;

$R_{line}$: resistance value per pixel of scanning line; and other variables are the same as those defined in equations (1), (2), (3) and (4).

9. An image display apparatus comprising:

a plurality of electron sources arranged into a matrix;

a scanning voltage supply circuit for supplying a scanning voltage for selecting said plurality of electron sources in a unit of line to scan them in the vertical direction to said selected electron sources;

a drive voltage supply circuit for supplying a drive voltage based on an inputted image signal to said electron sources of at least one line; and a correction circuit;

wherein each of electron sources of said one selected line emits electrons having an amount conformable to a potential difference between said scanning voltage and said drive voltage and said correction circuit corrects said potential difference at an electron source, disposed nearest to said scanning voltage supply circuit as a minimum, of said electron sources of said one selected line on the basis of a level of said image signal.

10. An image display apparatus comprising:

a plurality of electron sources arranged into a matrix;

a scanning voltage supply circuit disposed at least one of right and left ends of said plurality of electron sources and for supplying a scanning voltage for selecting said electron sources of at least one line successively in the vertical direction to scan them to said selected electron sources;

a drive voltage supply circuit for supplying a drive voltage based on an inputted image signal to said electron sources of at least one line; and a correction circuit for varying a level of said scanning voltage in accordance with a level of the image signal for said electron sources of said one selected line.

11. An image display apparatus comprising:

a plurality of electron sources arranged into a matrix;

a scanning voltage supply circuit for supplying a scanning voltage for selecting said electron sources of at least one line successively in the vertical direction to scan them to said selected electron sources;

a drive voltage supply circuit for supplying a drive voltage based on an inputted image signal to said electron sources of at least one line; and a correction circuit;

wherein said correction circuit gives to at least one of said scanning voltage and said drive voltage supplied to a head electron source, disposed nearest to said scanning voltage supply circuit, of said electron sources of said one selected line an offset conformable to a level of the image signal for said electron sources of said one selected line.

12. An image display apparatus according to claim 11, wherein said correction circuit makes correction having a level larger than or equal to said offset as a minimum to at least one of said scanning voltage and said drive voltage supplied to electron sources except said head electron source of said electron sources of said selected line when the levels of said image signals for said electron sources of said one selected line are equal.

13. An image display apparatus according to claim 11, wherein said offset has a level for compensating a voltage drop produced by an internal resistance of said scanning voltage supply circuit.

14. An image display apparatus according to claim 11, wherein said scanning voltage supply circuit includes a switch circuit which switches a selection potential and a non-selection potential to form said scanning voltage and said offset has a level for compensating a voltage drop produced by an internal resistance of said switch circuit.

15. An image display apparatus according to claim 11, wherein said scanning voltage supply circuit is disposed at both of right and left ends of said plurality of electron sources.

16. An image display apparatus comprising:

a plurality of electron sources arranged into a matrix;

a scanning voltage supply circuit for supplying a scanning voltage for selecting said plurality of electron sources in a unit of line to scan them in the vertical direction to said selected electron sources;

a drive voltage supply circuit for supplying a drive voltage based on an inputted image signal to said electron sources of at least one line; and a correction circuit;

wherein each of electron sources of said one selected line emits electrons of an amount conformable to a potential difference between said scanning voltage and said drive voltage and said correction circuit corrects said potential difference so as to compensate a voltage drop produced by an internal resistance of said scanning voltage supply circuit.

17. An image display apparatus comprising:

a plurality of electron sources arranged into a matrix;

a scanning voltage supply circuit for supplying a scanning voltage for selecting said electron sources of at least one line successively in the vertical direction to scan them to said selected electron sources;

a drive voltage supply circuit for supplying a drive voltage based on an inputted image signal to said electron sources of at least one line; and a correction circuit;

wherein said correction circuit gives an offset for compensating a voltage drop produced by an internal resistance of said scanning voltage supply circuit to at least one of said scanning voltage and said drive voltage supplied to said electron sources of said selected line.

18. An image display apparatus according to claim 17, wherein said scanning voltage supply circuit includes a switch circuit which switches a selection potential and a non-selection potential to form said scanning voltage and said internal resistance is an internal resistance of said switch circuit.

* * * * *